US007121640B2

(12) United States Patent
Kim

(10) Patent No.: US 7,121,640 B2
(45) Date of Patent: Oct. 17, 2006

(54) METHOD AND APPARATUS FOR ALIGNING IMAGE OF INK-JET PRINTER

(75) Inventor: Kyu-Sung Kim, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 371 days.

(21) Appl. No.: 10/839,339

(22) Filed: May 6, 2004

(65) Prior Publication Data

US 2004/0223019 A1 Nov. 11, 2004

(30) Foreign Application Priority Data

May 10, 2003 (KR) ..... 10-2003-0029622

(51) Int. Cl.
*B41J 29/38* (2006.01)

(52) U.S. Cl. ..... 347/14; 347/19; 347/37

(58) Field of Classification Search ..... None
See application file for complete search history.

(56) References Cited

U.S. PATENT DOCUMENTS 6,154,230 A * 11/2000 Holstun et al. ..... 347/19
6,450,710 B1 * 9/2002 Foster et al. ..... 400/58

* cited by examiner

*Primary Examiner*—Thinh Nguyen
(74) *Attorney, Agent, or Firm*—Staas & Halsey LLP

(57) ABSTRACT

A method of aligning an image of an ink-jet printer. The method includes detecting a first moving speed of the carriage, detecting a first fire pulse delay time corresponding to the first detected moving speed from coordinate information in which moving speeds of the carriage and fire pulse delay times corresponding to each of the moving speeds are used as coordinate values, and generating a fire pulse after the first detected fire pulse delay time passes.

20 Claims, 9 Drawing Sheets

METHOD AND APPARATUS FOR ALIGNING IMAGE OF INK-JET PRINTER

CROSS-REFERENCE TO RELATED APPLICATION

This application claims the priority of Korean Patent Application No. 2003-29622, filed on May 10, 2003, in the Korean Intellectual Property Office, the disclosure of which is incorporated herein in its entirety by reference.

BACKGROUND OF THE INVENTION

1. Field of the Invention

The present invention relates to printing performed using an ink-jet printer, and more particularly, to a method and apparatus for aligning an image of an ink-jet printer having a high quality to be printed on a printing paper.

2. Description of the Related Art

A fire pulse needed in a conventional apparatus for aligning an image of an ink-jet printer is generated using elements. As shown in FIG. 1, such a conventional apparatus includes, for example, an encoder sensing unit 10, a reference clock generating unit 12, a moving speed detecting unit 14, an interrupt generating unit 16, a central processing unit (CPU) 18, and a fire pulse generating unit 20. The fire pulse is a signal used to designate a printing position of an image to be printed on a printing paper. The encoder sensing unit 10 generates an encoder signal by sensing an encoder strip when a carriage (not shown) moves and outputs the generated encoder signal to the moving speed detecting unit 14 and the interrupt generating unit 16. The reference clock generating unit 12 generates a reference clock signal having a specified cycle and outputs the generated reference clock signal to the moving speed detecting unit 14. The moving speed detecting unit 14 detects the moving speed of the carriage in response to the encoder signal input from the encoder sensing unit 10 and the reference clock signal input from the reference clock generating unit 12 and outputs the detected moving speed to the CPU 18. In other words, the moving speed detecting unit 14 obtains the moving speed of the carriage by counting the cycle of the reference clock signal corresponding to the encoder signal having one cycle. The interrupt generating unit 16 generates an interrupt at each cycle of the encoder signal input from the encoder sensing unit 10 and outputs the generated interrupt to the CPU 18. The interrupt is a signal periodically generated by the interrupt generating unit 16 so that the CPU 18 forcibly controls calculation of a delay time of a fire pulse while a program is executed. The CPU 18 calculates the delay time of the fire pulse using the moving speed of the carriage input from the moving speed detecting unit 14 whenever the interrupt is generated by the interrupt generating unit 16, and outputs the calculated delay time of the fire pulse to the fire pulse generating unit 20. The fire pulse generating unit 20 generates the fire pulse after the delay time of the fire pulse input from the CPU 18 passes and outputs the generated fire pulse through an output terminal OUT1.

FIGS. 2A through 2C illustrate signals output from the encoder sensing unit 10, the reference clock generating unit 12, and the interrupt generating unit 16 shown in FIG. 1. FIG. 2A illustrates an encoder signal sensed by the encoder sensing unit 10, FIG. 2B illustrates a reference clock signal generated by the reference clock generating unit 12, and FIG. 2C illustrates an interrupt generated by the interrupt generating unit 16 at each cycle of the encoder signal. As shown in FIGS. 2A through 2C, the cycle of a reference clock signal corresponding to the encoder signal having one cycle is 6 times, and the moving speed of the carriage can be obtained by multiplying the cycle of the reference clock signal by a time occurring at one cycle of a specified reference clock signal.

However, when a single-pass printing operation is performed, a printing material having a low resolution is inevitably obtained, and in an acceleration and deceleration section of the carriage, the delay time of the fire pulse due to a variation in speed should be obtained by generating an interrupt at each cycle of an encoder signal. In other words, when an encoder interrupt is generated, the current moving speed of the carriage is sensed, and the delay time for the fire pulse for compensating an expected shooting position error is detected by predicting a shooting position of a printing paper from a sensing result. Frequent generation of an interrupt causes lowering of a printing processing speed of a printer. In addition, when a multi-pass printing operation is performed so as to increase resolution, the printing operation is performed only in a constant speed section of the carriage, or even though the printing operation is performed in the acceleration and deceleration section of the carriage, due to a fixed delay time for a fire pulse, a printing material having a low resolution is inevitably obtained.

BRIEF SUMMARY

The present invention provides a method for aligning an image of an ink-jet printer by which a multi-pass printing operation of a high quality is performed in an acceleration and deceleration section of a carriage.

The present invention also provides an apparatus for aligning an image of an ink-jet printer by which a multi-pass printing operation of a high quality is performed in an acceleration and deceleration section of a carriage.

According to an aspect of the present invention, there is provided a method of aligning an image of an ink-jet printer performing a printing operation by ejecting ink according to the movement of a carriage, the method including detecting a first moving speed of the carriage, detecting a first fire pulse delay time corresponding to the first detected moving speed from coordinate information in which moving speeds of the carriage and fire pulse delay times corresponding to each of the moving speeds are used as coordinate values, and generating a fire pulse after the first detected fire pulse delay time passes.

According to another aspect of the present invention, there is provided a computer readable storage medium encoded with processing instructions for causing a computer to perform a method of aligning an image of an ink-jet printer performing a printing operation by ejecting ink according to the movement of a carriage, the method including detecting a first moving speed of the carriage; detecting a first fire pulse delay time corresponding to the first detected moving speed from coordinate information in which moving speeds of the carriage and fire pulse delay times corresponding to each of the moving speeds are used as coordinate values; and generating a fire pulse after the first detected fire pulse delay time passes.

According to yet another aspect of the present invention, there is provided an apparatus for aligning an image of an ink-jet printer performing a printing operation by ejecting ink according to the movement of a carriage, the apparatus including a moving speed detecting unit, which detects a first moving speed of the carriage using a reference clock signal input from a reference clock generating unit for generating a reference clock signal and an encoder signal input from an encoder sensing unit for outputting the encoder signal and outputs the first detected moving speed, a coordinate information storage unit, which stores coordinate information in which moving speeds of the carriage and fire pulse delay times corresponding to each of the moving speeds are used as coordinate values, a delay time providing unit, which provides a first fire pulse delay time corresponding to the first detected moving speed, and a fire pulse generating unit, which generates a fire pulse after the first detected fire pulse delay time passes.

According to another aspect of the present invention, there is provided a method of aligning an image of an ink-jet printer performing a printing operation by ejecting ink according to the movement of a carriage without generating an interrupt in the movement of the carriage. The method includes: detecting a first moving speed of the carriage; detecting a first fire pulse delay time corresponding to the first detected moving speed from coordinate information in which moving speeds of the carriage and fire pulse delay times corresponding to each of the moving speeds are used as coordinate values; and generating a fire pulse after the first detected fire pulse delay time passes.

According to another aspect of the present invention, there is provided a delay time providing unit including: a setting coordinate sensing portion which senses whether a first coordinate in which a first moving speed and a first pulse delay time corresponding to the first moving speed are used as a coordinate value, is set in coordinate information, and outputs a sensing result; and a delay time drawing-out portion which draws out, when the sensing result indicates that the first coordinate is set in the coordinate information, a first fire pulse delay time directly from the coordinate information and draws out, when the sensing result indicates that the first coordinate is not set in the coordinate information, a first pulse delay time from a straight-line equation passing both a second coordinate in which a second moving speed lower than the first moving speed and a second pulse delay time corresponding to the second moving speed are used as a coordinate value, and a third coordinate in which a third moving speed higher than the first moving speed and a third fire pulse delay time corresponding to the third moving speed are used as a coordinate value in response to the sensing result of the setting coordinate sensing portion.

Additional and/or other aspects and advantages of the present invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following detailed description, taken in conjunction with the accompanying drawing of which.

DETAILED DESCRIPTION OF EMBODIMENTS

Figure 1:
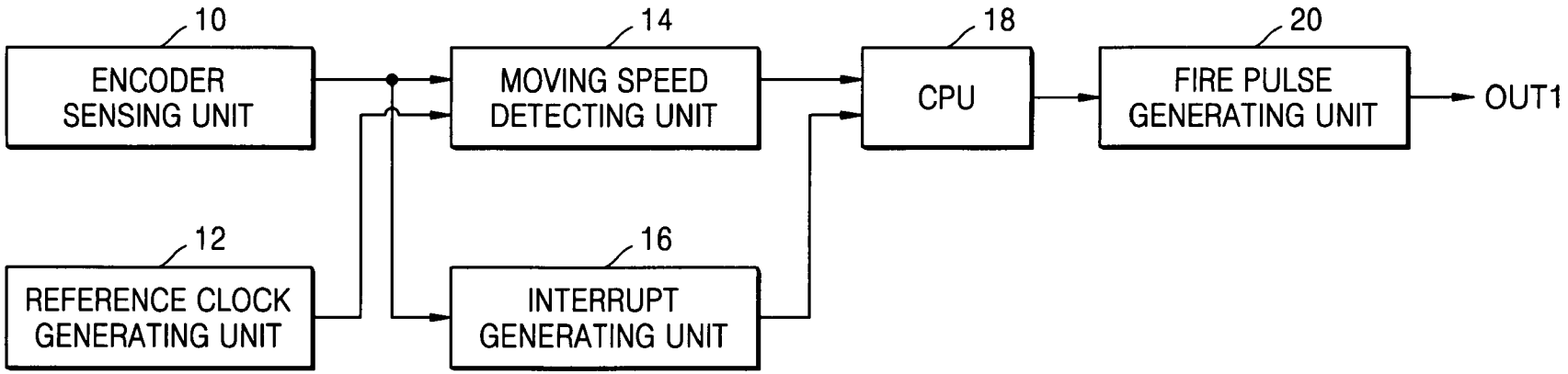
FIG. 1 (PRIOR ART)
FIG. 1 is a block diagram illustrating a conventional apparatus for aligning an image of an ink-jet printer according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

Hereinafter, a method for aligning an image of an ink-jet printer according to the present invention will be described to the accompanying drawings.

Figure 3:
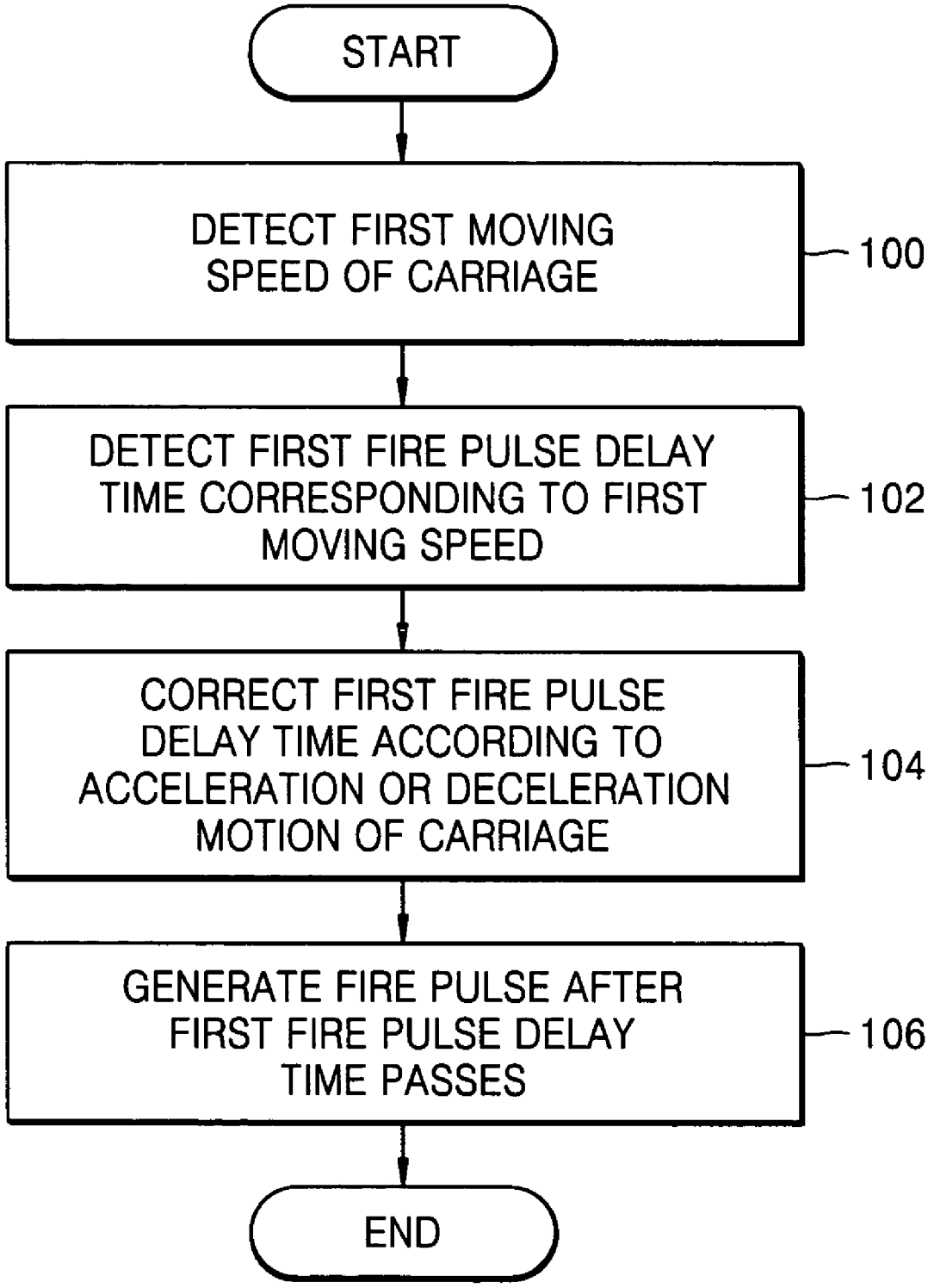
FIG. 3 is a flowchart illustrating a method for aligning an image of an ink-jet printer according to an embodiment of the present invention.

FIG. 3 is a flowchart illustrating a method for aligning an image of an ink-jet printer according to an embodiment of the present invention. The method for aligning an image of an ink-jet printer according to this embodiment of the present invention includes generating a fire pulse after a first detected fire pulse delay time passes (operations 100 through 106).

First, in operation 100, a first moving speed of a carriage is detected. The carriage makes an acceleration motion when a printing operation starts for one line. When the carriage reaches a specified speed, the carriage makes a uniform motion, and when the printing operation ends for the one line, the carriage makes a deceleration motion. A first current moving speed of the carriage among a variety of moving speeds of the carriage is detected.

After operation 100, in operation 102, a first fire pulse delay time corresponding to a first moving speed is detected from coordinate information in which moving speeds of the carriage and fire pulse delay times corresponding to each of the moving speeds of the carriage are used as coordinate values. As described above, the carriage makes an acceleration motion (accelerates), a deceleration motion (decelerates), and a uniform motion according to moving sections. When the carriage is in uniform motion, the fire pulse is generated without time delay in response to an encoder signal. However, when the carriage makes the acceleration and deceleration motion (accelerates or decelerates), due to the variation in speed, ink is ejected, and errors occur at a position where the printing paper drops. Thus, a fire pulse delay time for adjusting a time where a fire pulse is generated to correct the errors, is required. Optimum fire pulse delay times according to the rates of acceleration and deceleration motion of the carriage are obtained by experiment.

Figure 4:
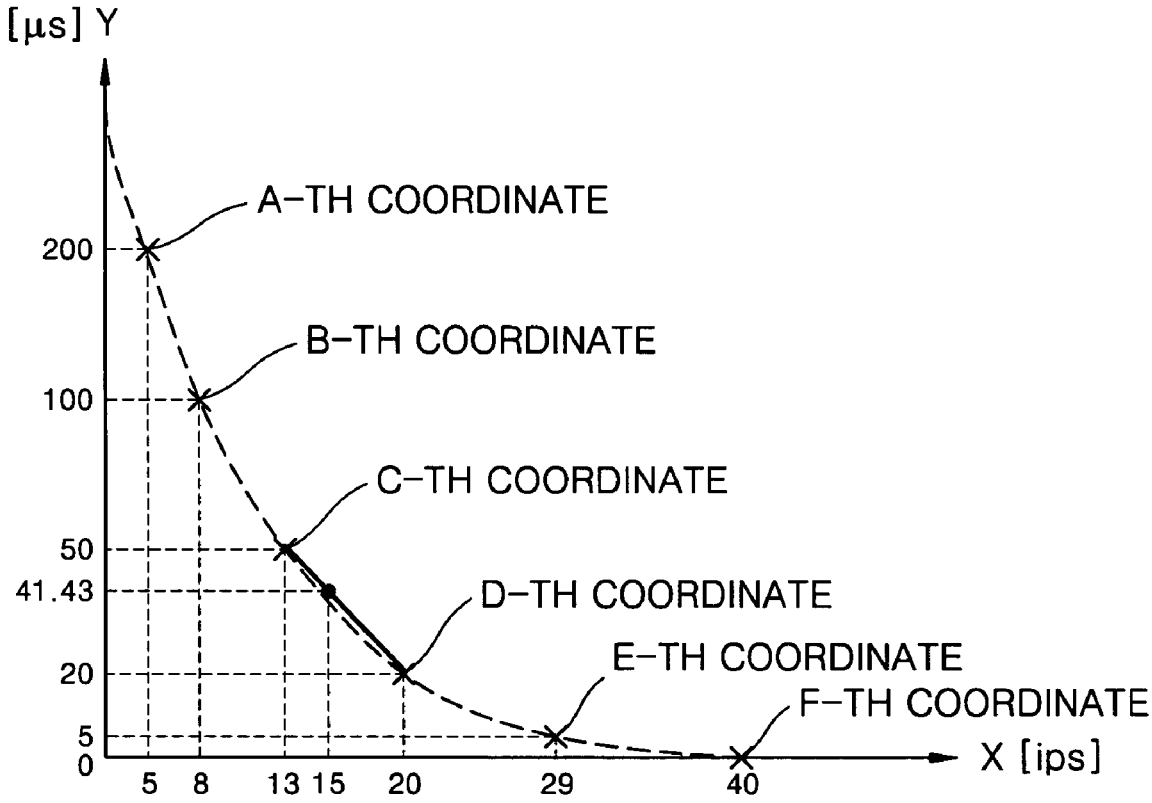
FIG. 4 is a graph showing coordinate information according to various embodiments the present invention.

Fire pulse delay times corresponding to n moving speeds selected from moving speeds varied according to the acceleration and deceleration motion of the carriage are obtained by experiment. Here, n is defined as a proper number by considering the storage capacity of data. When n is so small, errors in the obtained fire pulse delay times may increase, and when n is so large, the storage capacity of the n moving speeds and the fire pulse delay times corresponding to the n moving speeds should be large. The n moving speeds are coordinate values on a horizontal axis, and the fire pulse delay times corresponding to each of the n moving speeds are coordinate values on a vertical axis. Thus, the coordinate values on the horizontal axis and the coordinate values on the vertical axis are provided as coordinate information corresponding to the fire pulse delay time. FIG. 4 is a graph showing coordinate information according to the present embodiment of the present invention and illustrates each of fire pulse delay times with respect to moving speeds of the carriages at six points. A dotted line passing the six points is a curved line indicating the variation in fire pulse delay times according to the variation in the moving speed of the carriage. A unit for the moving speed of the carriage corresponding to the horizontal axis is inch per second ips, in which the moving speed of the carriage is indicated by inch per second. A unit for the fire pulse delay time corresponding to the vertical axis is micro second ps. When the carriage starts to move, the carriage makes an acceleration motion of 5, 8, 13, 20, and 29 ips corresponding to coordinate values on the horizontal axis of an a-th coordinate, a b-th coordinate, a c-th coordinate, a d-th coordinate, and an e-th coordinate and reaches a constant speed moving speed of 40 ips corresponding to a coordinate value on the horizontal axis of an f-th coordinate. Subsequently, when the carriage is decelerated, the carriage makes a deceleration motion in a reverse order of the above-described moving speed. Fire pulse delay times needed in making an acceleration and deceleration motion of the carriage or the constant speed motion of the carriage are 200, 100, 50, 20, 5, and 0 μs corresponding to coordinate values on the vertical axis of the a-th coordinate, the b-th coordinate, the c-th coordinate, the d-th coordinate, the e-th coordinate, and the f-th coordinate. In other words, when the carriage makes the acceleration and deceleration motion, a fire pulse delay time, such as 200, 100, 50, 20, 5 or 0 μs, is needed, and when the carriage makes the constant speed motion, a fire pulse delay time of 0 μs is needed. The first fire pulse delay time corresponding to the first moving speed is detected from the coordinate information provided in this manner. The first moving speed may be or may not be one selected from the above-described coordinate values on the horizontal axis of the a-th coordinate, the b-th coordinate, the c-th coordinate, the d-th coordinate, the e-th coordinate or the f-th coordinate. When the first moving speed is one selected from the coordinate values on the horizontal axis of the a-th coordinate, the b-th coordinate, the c-th coordinate, the d-th coordinate, the e-th coordinate or the f-th coordinate, the fire pulse delay time is immediately obtained from coordinate information. However, when the first moving speed is not one selected from the coordinate values on the horizontal axis of the a-th coordinate, the b-th coordinate, the c-th coordinate, the d-th coordinate, the e-th coordinate or the f-th coordinate, a procedure of obtaining a fire pulse delay time is required.

Figure 5A:
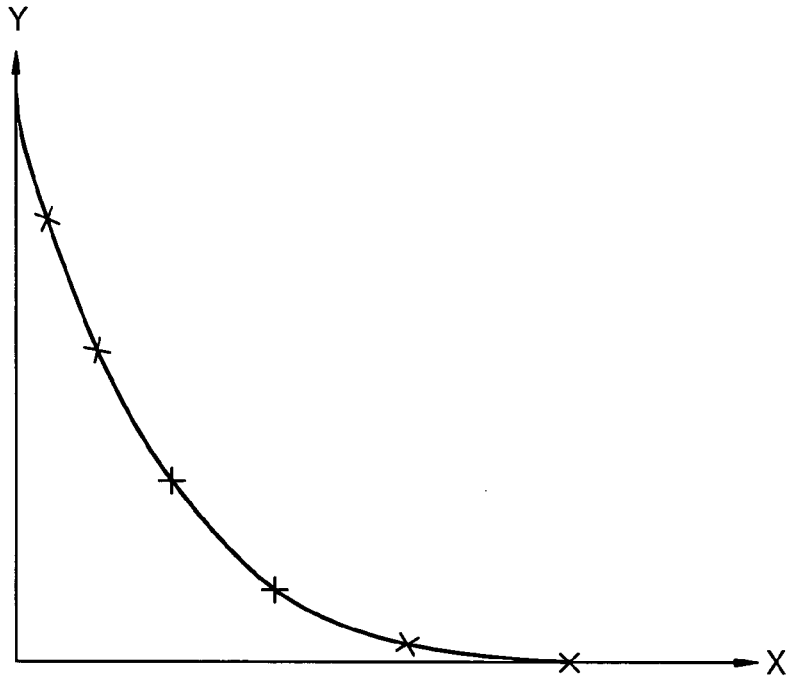
FIGS. 5A through 5D are graphs showing coordinate information used in each pass when a multi-pass printing operation is performed.
Figure 5B:
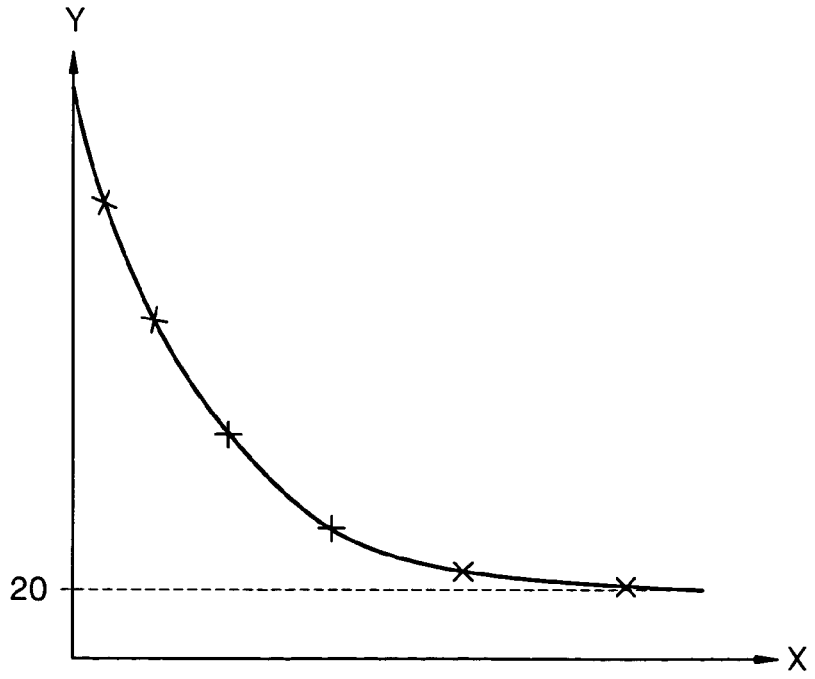
Figure 5C:
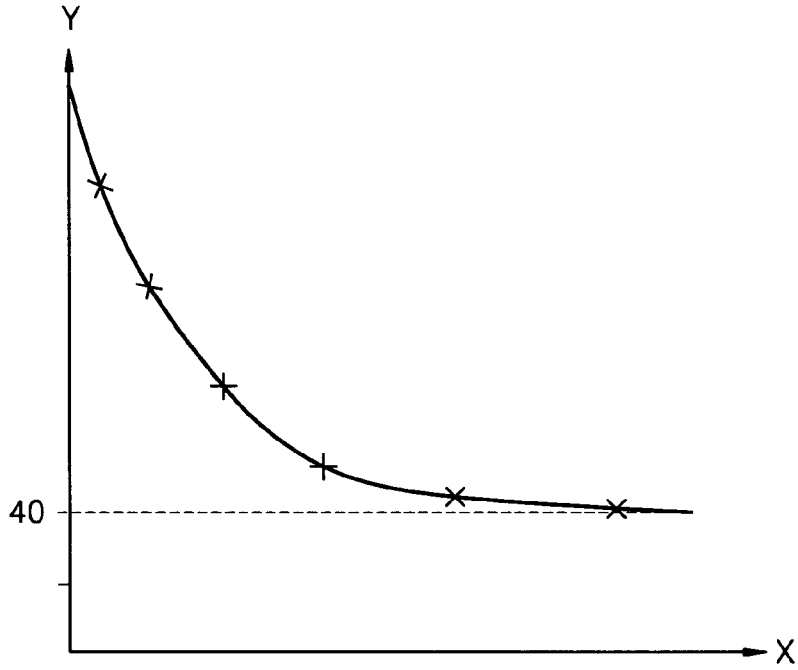
Figure 5D:
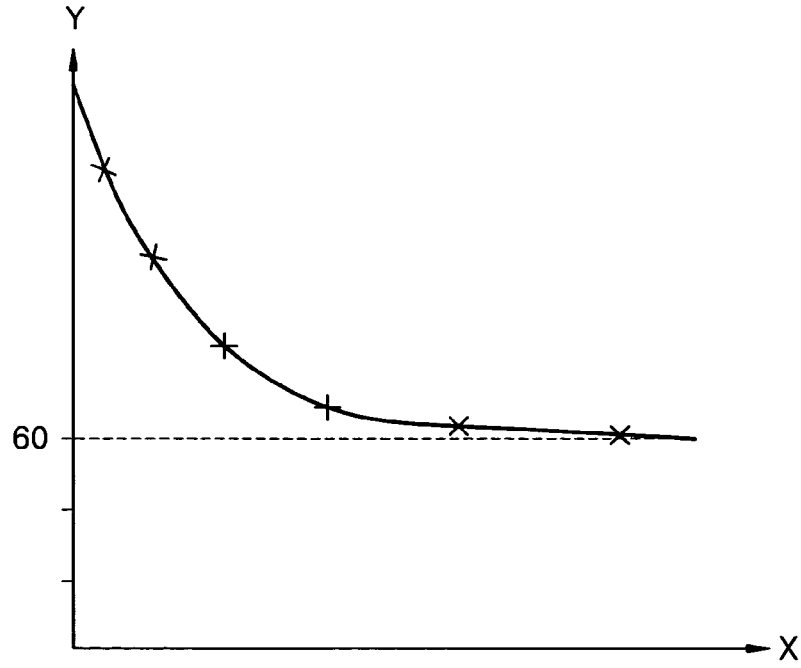

Meanwhile, when a single-pass printing operation is performed, the first fire pulse delay time is detected using the above-described coordinate information. However, when a multi-pass printing operation is performed, the above-described coordinate information should be varied in each pass. For example, in a case of an ink-jet printer performing a four-pass printing operation, in a first pass, fire pulses are generated while maintaining a gap of 600 dot per inch dpi. In a second pass, fire pulses are generated while maintaining a gap of 2400 dpi with the fire pulses generated in the first pass. In a third pass, fire pulses are generated while maintaining a gap of 2400 dpi with the fire pulses generated in the second pass. In a fourth pass, fire pulses are generated while maintaining a gap of 2400 dpi with the fire pulses generated in the third pass. Thus, due to the multi-pass, a printing operation having a high resolution is performed. A fire pulse delay time is further delayed by a specified time so that the fire pulses are maintained with a gap of 2400 dpi for each pass. Thus, new coordinate information in which a specified time for multi-pass is added to the fire pulse delay times corresponding to the above-described coordinate information on the vertical axis, is provided. FIGS. 5A through 5D are graphs showing coordinate information used in each pass when a multi-pass printing operation is performed. FIG. 5A illustrates coordinate information in a first pass in a state where a specified time is not added to a fire pulse delay time, FIG. 5B illustrates coordinate information in a second pass in which a specified time (i.e., 20 μs) is added to a fire pulse delay time, FIG. 5C illustrates coordinate information in a third pass in which a specified time (i.e., 40 μs) is added to a fire pulse delay time, and FIG. 5D illustrates coordinate information in a fourth pass in which a specified time (i.e., 60 μs) is added to a fire pulse delay time.

Figure 6:
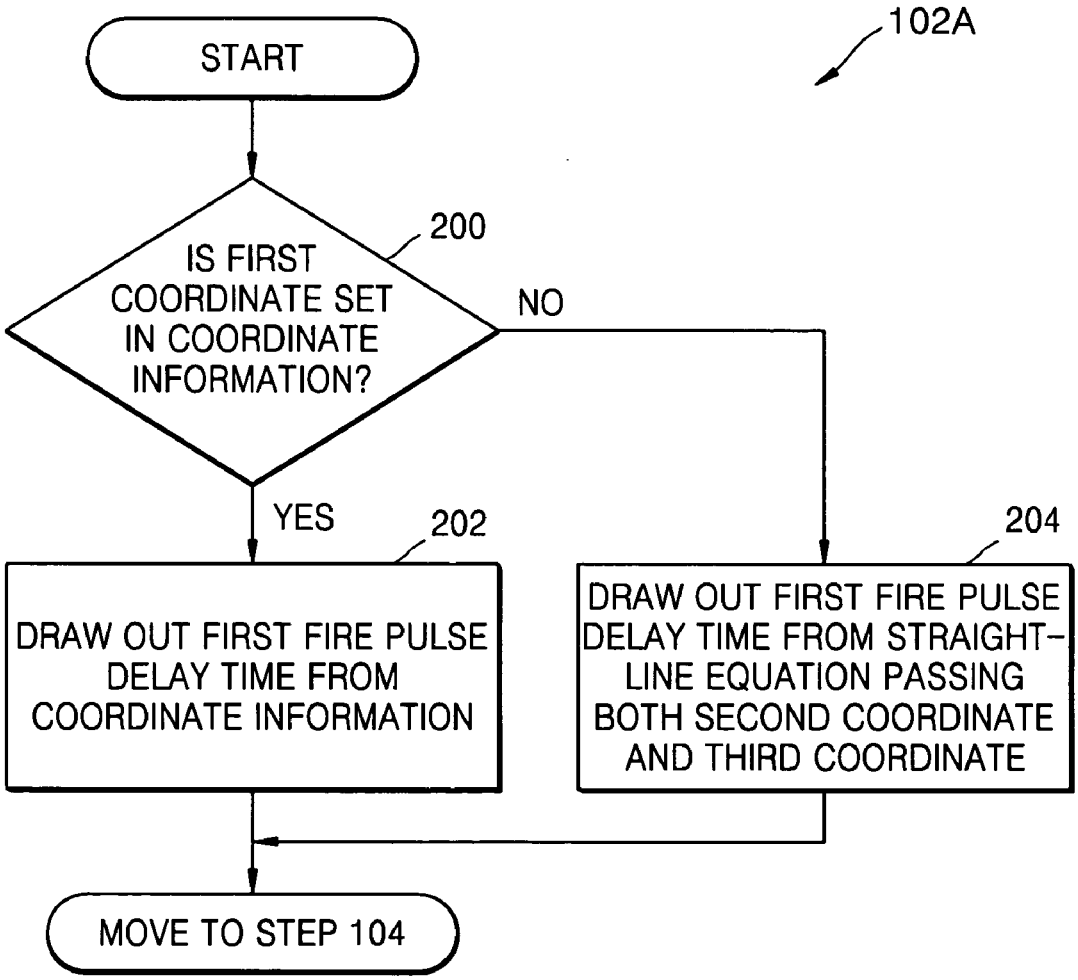
FIG. 6 is a flowchart illustrating operation 102 shown in FIG. 3, according to an embodiment of the present invention.

FIG. 6 is a flowchart illustrating operation 102 shown in FIG. 3, according to an embodiment of the present invention. The operation 102 includes drawing-out a first pulse delay time depending on whether a first coordinate is set in coordinate information (operations 200 through 204).

First, in operation 200, whether a first coordinate in which a first moving speed and the first pulse delay time corresponding to the first moving speed are used as a coordinate value, is set in the coordinate information is determined. For example, whether there is a coordinate value on a horizontal axis coincident with the first moving speed among the coordinate values on the horizontal axis of the a-th through f-th coordinates shown in FIG. 4, is determined. When the first moving speed is 15 ips, there is no coordinate value on the horizontal axis corresponding to 15 ips from the coordinate information shown in FIG. 4, whether the first coordinate is set in the coordinate information is determined. However, when the first moving speed is 20 ips, the coordinate value on the horizontal axis of the d-th coordinate among the coordinate information shown in FIG. 4 corresponds to 20 ips, it is determined that the first coordinate is set in the coordinate information.

If it is determined that the first coordinate is set in the coordinate information, in operation 202, the first pulse delay time is drawn-out from the coordinate information. For example, when the first moving speed is 20 ips, the fire pulse delay time 20 μs corresponding to the coordinate value on the vertical axis of the d-th coordinate is drawn-out from the coordinate information shown in FIG. 4.

However, if it is determined that the first coordinate is not set in the coordinate information, in operation 204, the first pulse delay time is drawn-out from a straight-line equation passing a second coordinate in which a second moving speed lower than the first moving speed and a second pulse delay time corresponding to the second moving speed are used as a coordinate value, and a third coordinate in which a third moving speed higher than the first moving speed and a third fire pulse delay time corresponding to the third moving speed are used as a coordinate value. For example, when the first moving speed is 15 ips, the b-th coordinate or the c-th coordinate among the coordinate information shown in FIG. 4 corresponds to the second coordinate, and the d-th coordinate or the e-th coordinate among the coordinate information shown in FIG. 4 corresponds to the third coordinate. The c-th coordinate corresponds to the second coordinate, and the d-th coordinate corresponds to the third coordinate. A straight-line equation passing (13, 50) corresponding to the c-th coordinate and (20, 20) corresponding to the d-th coordinate is obtained by Equation 1.

$$y=-30(x-13)/7+50 \quad (1)$$

Here, x is a variable indicating the variation in the moving speed of a carriage, and y is a variable indicating the variation in a fire pulse delay time obtained according to the variation in x.

When 15 ips corresponding to the first moving speed is substituted for x of the above-described Equation 1, the first fire pulse delay time corresponding to the first moving speed is expressed as y=41.43. A straight line passing (13,50) corresponding to the c-th coordinate and (20, 20) corresponding to the d-th coordinate is shown in FIG. 4. The first pulse delay time obtained by Equation 1 is not an original coordinate value on a curved line but a value satisfying a straight-line equation connecting two points.

Meanwhile, after operation 102, in operation 104, the first drawn-out pulse delay time is corrected according to an inclination slope of the acceleration or deceleration motion of the carriage. When a fire pulse delay time is drawn-out only by the current moving speed of the carriage, errors may occur in position where a fire pulse is generated, when the carriage makes the acceleration or deceleration motion. To this end, the first drawn-out pulse delay time is corrected according to the inclination of the acceleration or deceleration motion of the carriage.

A straight-line equation of obtaining a fire pulse delay time using a first function so as to correct the first drawn-out pulse delay time may be obtained by Equation 2.

$$D_i=a*T_i+b \quad (2)$$

Here, $D_i$ is a fire pulse delay time having an i-th encoder cycle, $T_i$ is a time having the i-th encoder cycle, and a and b are constants satisfying the first function having the i-th encoder cycle.

A differentiation result of $D_i$ obtained in operation 202 is expressed as Equation 3.

$$D_i'=a=dD_i/dT_i=(D_i-D_{i-1})/\Delta T \quad (3)$$

Here, $D_{i-1}$, is an (i−1)-th fire pulse delay time, and ΔT is a time during one cycle of an encoder signal.

A solution result of Equation 2 using the constant b is expressed as Equation 4.

$$b=D_i-a*T_i=D_i-D_i'*T_i \quad (4)$$

An (i+1)-th straight-line equation shown in Equation 5 is obtained using Equation 2.

$$D_{i+1}=a*T_{i+1}+b \quad (5)$$

Equation 5 shows a corrected time of a first pulse delay time according to the inclination of the acceleration or deceleration motion of the carriage. If the above-described constants a and b are substituted for Equation 5, the following Equation 6 can be obtained.

$$D_{i+1}=D_i'*T_{i+1}+D_i-D_i'*T_i=D_i'*(T_{i+1}-T_i)+D_i=2*D_i-D_{i-1} \quad (6)$$

Equation 6 shows a corrected time of a first fire pulse delay time. In other words, in order to obtain the first corrected fire pulse delay time having a current cycle, the first corrected fire pulse delay time is obtainable from Equation 6 using $D_{i-1}$ corresponding to a first fire pulse delay time two cycle earlier than a current cycle of the encoder signal and $D_i$ corresponding to a first fire pulse delay time one cycle earlier than the current cycle of the encoder signal.

Meanwhile, correction of the first fire pulse delay time using Equation 6 corresponds to an example, and correction is more precisely performable according to the variation in moving speeds of the carriage.

After operation 104, in operation 106, a fire pulse is generated after the first corrected fire pulse delay time passes. When the carriage is in uniform motion, the fire pulse is generated without time delay in response to the encoder signal. However, if the carriage makes the acceleration or deceleration motion (accelerates or decelerates), the fire pulse is generated after the first corrected fire pulse delay time passes. Ink is ejected by the fire pulse generated in operation 106, and thus, a printing operation is performed.

Figure 7:
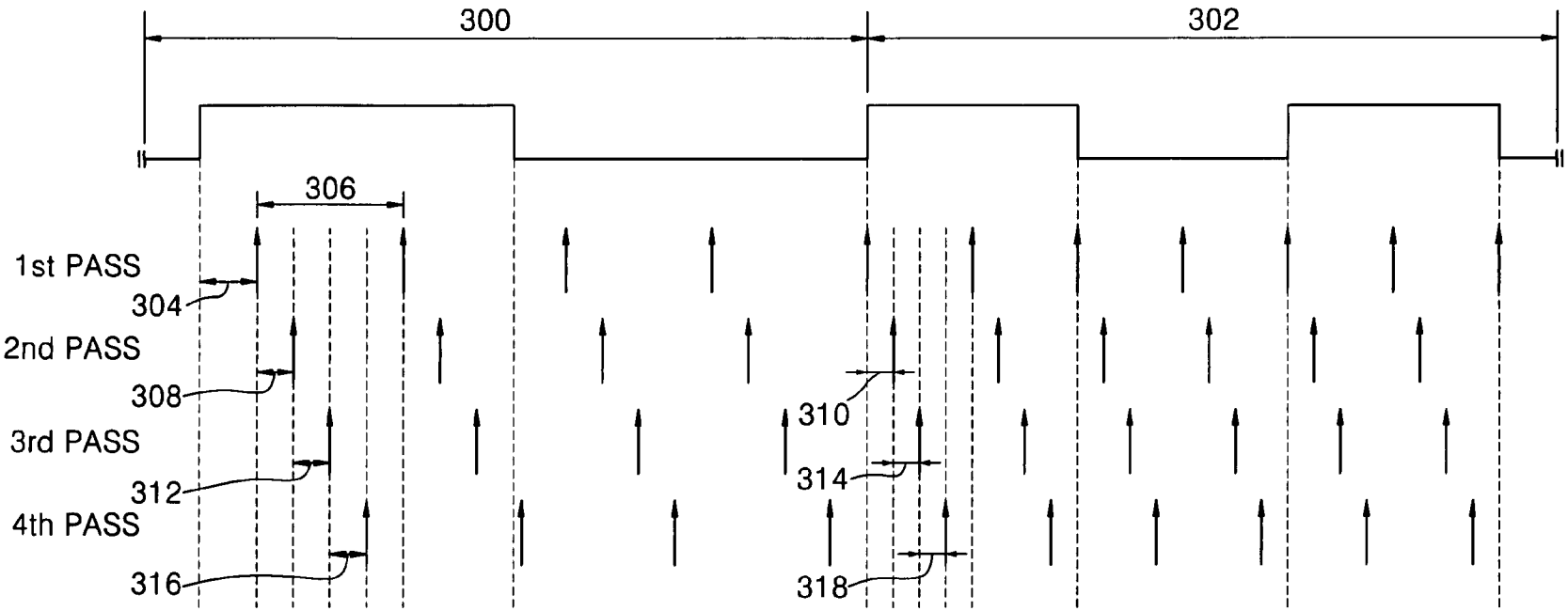
FIG. 7 illustrates fire pulses generated according to an embodiment the present invention and compared to encoder pulses.

FIG. 7 illustrates fire pulses generated using a multi-pass printing operation according to an embodiment of the present invention and compared to encoder signals. Reference numeral 300 denotes an encoder signal generated when the carriage makes an acceleration motion, and reference numeral 302 denotes an encoder signal generated when the carriage makes a constant speed motion. When the carriage makes the acceleration motion in a first pass, a fire pulse is generated after a specified fire pulse delay time corresponding to reference numeral 304 passes. After that, fire pulses in the first pass are generated with a gap of 600 dpi corresponding to reference numeral 306. When the carriage makes the constant speed motion in the first pass, unlike in the acceleration motion, time delay due to the generation of fire pulses does not occur. When the carriage makes the acceleration motion in a second pass, a fire pulse that maintains a gap of 2400 dpi with the first fire pulse in the first pass is generated. The gap of 2400 dpi corresponds to reference numeral 308. After that, fire pulses in the second pass are generated with a gap of 600 dpi corresponding to reference numeral 306. When the carriage makes the constant speed motion in the second pass, fire pulses that maintain a gap of 2400 dpi with the fire pluses generated when the carriage makes the constant speed motion in the first pass and correspond to reference numeral 310, are generated. Even in a third pass and a fourth pass, like in the second pass, a fire pulse is generated. In other words, the gap corresponding to reference numerals 312, 314, 316, and 318 is maintained by 2400 dpi.

Hereinafter, an apparatus for aligning an image of an ink-jet printer according to an embodiment of the present invention will be described.

Figure 8:
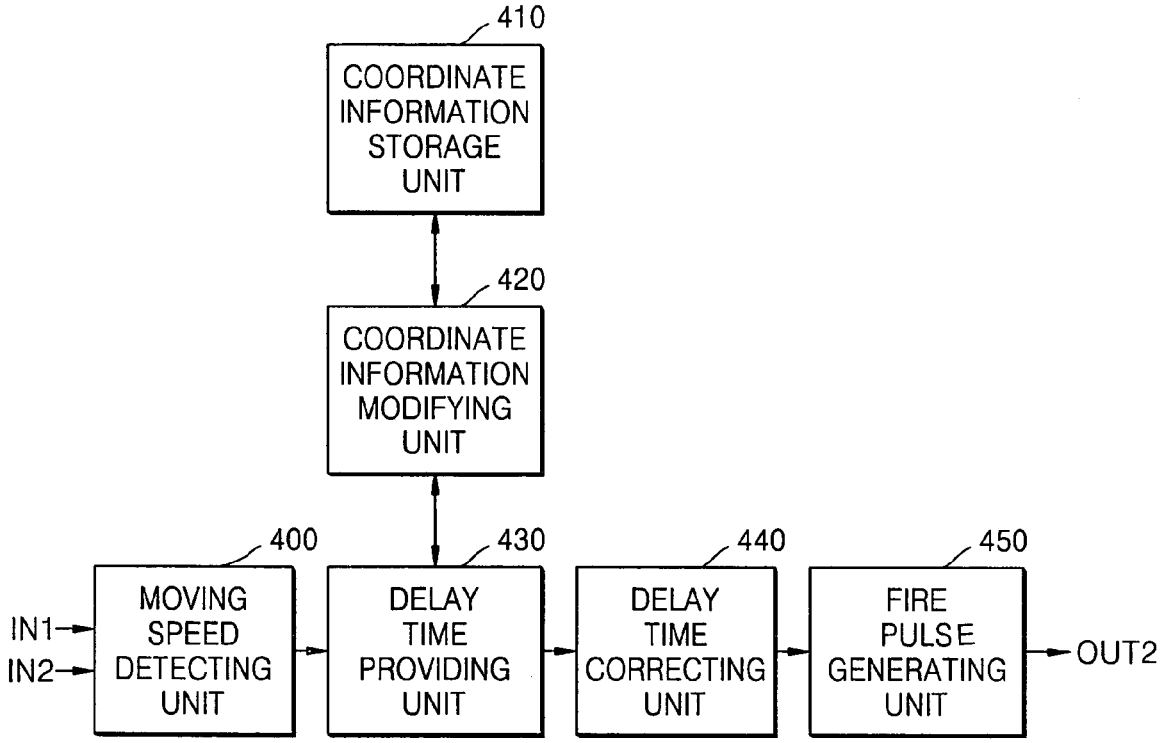
FIG. 8 is a block diagram illustrating an apparatus for aligning an image of an ink-jet printer according to an embodiment of the present invention.

FIG. 8 is a block diagram illustrating an apparatus for aligning an image of an ink-jet printer according to an embodiment of the present invention. The apparatus for aligning an image of an ink-jet printer according to this embodiment of the present invention includes a moving speed detecting unit 400, a coordinate information storage unit 410, a coordinate information modifying unit 420, a delay time providing unit 430, a delay time correcting unit 440, and a fire pulse generating unit 450.

Figures 2A, 2B, 2C:
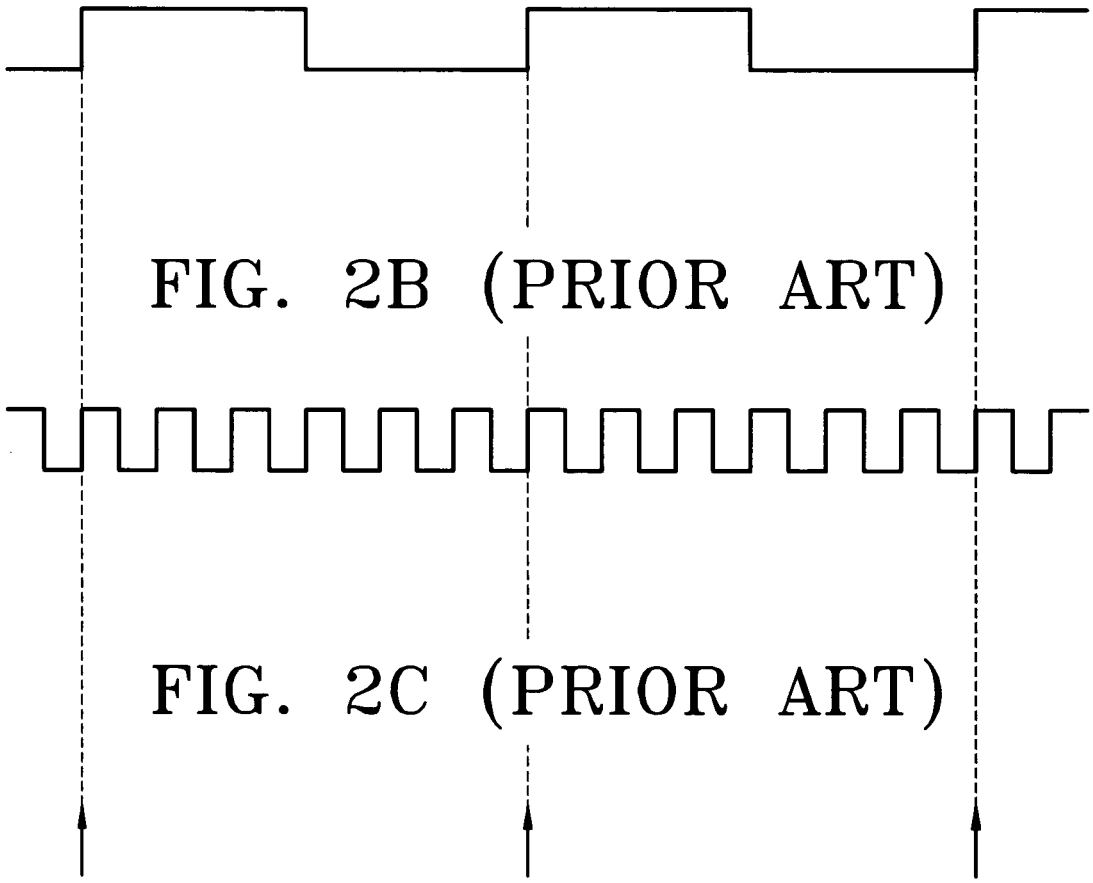
FIG. 2A (PRIOR ART)
FIG. 2B (PRIOR ART)
FIG. 2C (PRIOR ART)
FIGS. 2A through 2C illustrate signals output from an encoder sensing unit, a reference clock generating unit, and an interrupt generating unit shown in FIG. 1.

The moving speed detecting unit 400 detects a first moving speed of a carriage (not shown) using a reference clock signal input through an input terminal IN1 from a reference (not shown) clock generating unit for generating a reference clock signal and an encoder signal input through an input terminal IN2 from an encoder sensing unit (not shown) for sensing an encoder strip and outputs the first detected moving speed to the delay time providing unit 430. As previously explained with reference to FIG. 2, the first moving speed of the carriage (not shown) is obtained by counting the cycle of the reference clock signal corresponding to the encoder signal having one cycle.

The coordinate information storage unit 410 stores coordinate information in which moving speeds of the carriage and pulse delay times corresponding to each of the moving speeds of the carriage are used as coordinate values. For example, the coordinate information shown in FIG. 4 is stored. If there is a request for the coordinate information from the coordinate information modifying unit 420, the coordinate information storage unit 410 supplies the coordinate information to the coordinate information modifying unit 420.

The coordinate information modifying unit 420 adds a specified amount of time to fire pulse delay times corresponding to coordinate values of the coordinate information according to times of multi-pass in response to a request signal of a fire pulse delay time of the delay time providing unit 430 and outputs the fire pulse delay times to which the specified amount of time is added, to the delay time providing unit 430. When a multi-pass printing operation is performed, the generation of fire pulses needs to be delayed by adding a specified amount of time to the fire pulse delay times corresponding to the coordinate values of the coordinate information shown in FIG. 4 in each pass. As shown in FIG. 5, in a second pass, the coordinate information modifying unit 420 outputs the corrected fire pulse delay times in which a specified amount of time (i.e., 20 μs) is added to the fire pulse delay times. In addition, in a third pass, the coordinate information modifying unit 420 outputs the corrected fire pulse delay times in which a specified amount of time (i.e., 40 μs) is added to the fire pulse delay times. In addition, in a fourth pass, the coordinate information modifying unit 420 outputs the corrected fire pulse delay times in which a specified amount of time (i.e., 60 μs) is added to the fire pulse delay times.

The delay time providing unit 430 detects a first fire pulse delay time corresponding to the first moving speed detected by the moving speed detecting unit 400 and provides the first detected fire pulse delay time to the delay time correcting unit 440.

Figure 9:
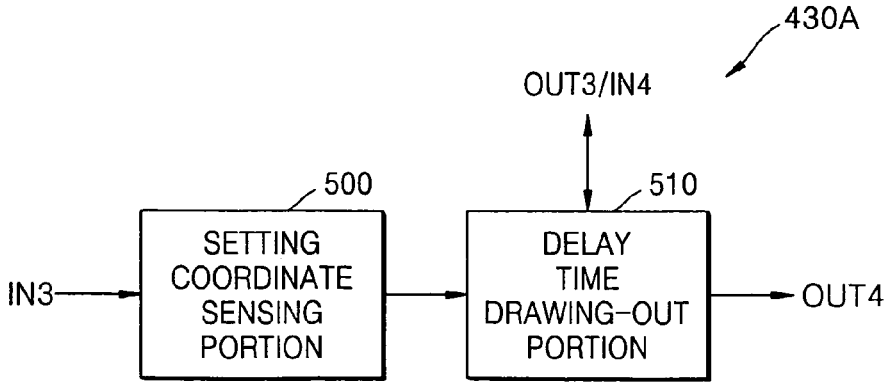
FIG. 9 is a block diagram illustrating a delay time providing unit shown in FIG. 8, according to an embodiment of the present invention.

FIG. 9 is a block diagram illustrating a delay time providing unit 430 shown in FIG. 8. The delay time providing unit 430 includes a setting coordinate sensing portion 500 and a delay time drawing-out portion 510.

The setting coordinate sensing portion 500 senses whether a first coordinate in which a first moving speed and a first pulse delay time corresponding to the first moving speed are used as a coordinate value, is set in coordinate information, and outputs a sensing result. If the first moving speed is input through an input terminal IN3, the setting coordinate sensing portion 500 senses whether there is the same moving speed as the first moving speed among moving speeds corresponding to coordinate values on a horizontal axis of the coordinate information previously provided in the setting coordinate sensing portion 500, and outputs a sensing result to the delay time drawing-out portion 510.

The delay time drawing-out portion 510 draws out a first fire pulse delay time directly from the coordinate information or draws out a first pulse delay time from a straight-line equation passing both a second coordinate in which a second moving speed lower than the first moving speed and a second pulse delay time corresponding to the second moving speed are used as a coordinate value, and a third coordinate in which a third moving speed higher than the first moving speed and a third fire pulse delay time corresponding to the third moving speed are used as a coordinate value in response to the sensing result of the setting coordinate sensing portion 500. If the setting coordinate sensing portion 500 senses that there is the same moving speed as the first moving speed, the delay time drawing-out portion 510 recognizes that a first coordinate in which a first moving speed and a first fire pulse delay time corresponding to the first moving speed are used as a coordinate value, exists in the coordinate information and requests the coordinate information modifying unit 420 of first coordinate information through an output terminal OUT3. The delay time drawing-out portion 510 draws out the first fire pulse delay time corresponding to the coordinate value of the first coordinate from the coordinate information modifying unit 420 through an input terminal IN4 and outputs the first drawn-out fire pulse delay time to the delay time correcting unit 440 through an output terminal OUT4. Meanwhile, if the setting coordinate sensing portion 500 senses that there is no same moving speed as the first moving speed, the delay time drawing-out portion 510 recognizes that a first coordinate in which the first moving speed and the first fire pulse delay time corresponding to the first moving speed are used as a coordinate value, does not exist in the coordinate information and requests the coordinate information modifying unit 420 of second and third coordinates through the output terminal OUT3. The delay time drawing-out portion 510 obtains a straight-line equation passing both the second and third coordinates input from the coordinate information modifying unit 420 through an input terminal IN4, draws out the first fire pulse delay time by substituting the first moving speed for the obtained straight-line equation, and outputs the first drawn-out fire pulse delay time to the delay time correcting unit 440 through the output terminal OUT4.

The delay time correcting unit 440 corrects the first drawn-out fire pulse delay time according to an inclination of the acceleration or deceleration motion of the carriage. The delay time correcting unit 440 corrects the first fire pulse delay time using the above-described Equation 6 according to the inclination of the acceleration or deceleration motion of the carriage with respect to the first fire pulse delay time input from the delay time providing unit 430 and outputs the first corrected fire pulse delay time to the fire pulse generating unit 450.

The fire pulse generating unit 450 generates a fire pulse after the first fire pulse delay time corrected by the delay time correcting unit 440 passes, and outputs the generated fire pulse through an output terminal OUT2.

As described above, in the method and apparatus for aligning an image of an ink-jet printer according to the present invention, when a printing operation is performed using an ink-jet printer, a multi-pass printing operation of a high quality can be performed in an acceleration and deceleration moving section of a carriage without generating an interrupt, and a printing speed is improved.

Although a few embodiments of the present invention have been shown and described, the present invention is not limited to the described embodiments. Instead, it would be appreciated by those skilled in the art that changes may be made in these embodiments without departing from the principles and spirit of the invention, the scope of which is defined by the claims and their equivalents.

What is claimed is:

1. A method of aligning an image of an ink-jet printer performing a printing operation by ejecting ink according to the movement of a carriage, comprising:

detecting a first moving speed of the carriage;

detecting a first fire pulse delay time corresponding to the first detected moving speed from coordinate information in which moving speeds of the carriage and fire pulse delay times corresponding to each of the moving speeds are used as coordinate values; and generating a fire pulse after the first detected fire pulse delay time passes.

2. The method of claim 1, wherein the detecting of a first fire pulse delay time comprises:

determining whether a first coordinate in which the first moving speed and the first fire pulse delay time corresponding to the first moving speed are used as a coordinate value is set in the coordinate information;

drawing-out the first fire pulse delay time from the coordinate information in response to determining that the first coordinate is set in the coordinate information; and drawing-out the first fire pulse delay time from a straight-line equation passing both a second coordinate in which a second moving speed lower than the first moving speed and a second pulse delay time corresponding to the second moving speed are used as a coordinate value, and a third coordinate in which a third moving speed higher than the first moving speed and a third fire pulse delay time corresponding to the third moving speed are used as a coordinate value in response to determining that the first coordinate is not set in the coordinate information.

3. The method of claim 2, wherein the moving speed of the carriage corresponding to the horizontal axis is measured in inches per second ips, the fire pulse delay time corresponding to the vertical axis is measured in microseconds μs.

4. The method of claim 3, wherein the set coordinate information for moving speeds are 5, 8, 13, 20, 29 and 40 ips and the set coordinate information for fire pulse delay times are respectively 200, 100, 50, 20, 5, and 0 μs.

5. The method of claim 2, wherein the straight-line equation is $y=-30(x-X)/7+Y$, wherein x is a variable indicating the variation in the moving speed of a carriage, y is a variable indicating the variation in a fire pulse delay time obtained according to the variation in x, X is horizontal component of the third coordinate, and Y is the vertical component of the third coordinate.

6. The method of claim 1, further comprising correcting, after the detecting of a first fire pulse delay time, the first drawn-out fire pulse delay time according to a slope of one of an acceleration and a deceleration motion of the carriage.

7. The method of claim 6, wherein the correcting comprises:

obtaining a straight-line equation to obtain a fire pulse delay time using a first function so as to correct the first drawn-out pulse delay time by $$D_i=a*T_i+b,$$

where, $D_i$ is a fire pulse delay time having an i-th encoder cycle, $T_i$ is a time having the i-th encoder cycle, and a and b are constants satisfying the first function having the i-th encoder cycle;

obtaining a differentiation result of $D_i$ which is expressible as $$D_i'=a=dD_i/dT_i=(D_i-D_{i-1})/\Delta T,$$

where $D_{i-1}$ is an (i−1)-th fire pulse delay time, and ΔT is a time during one cycle of an encoder signal;

obtaining a solution of the straight-line equation using the constant b expressible as $$b=D_i-a*T_i=D_i-D_i'*T_i;$$

obtaining an (i+1)-th straight-line equation using the straight line equation $$D_{i+1}=a*T_{i+1}+b,$$

which shows a corrected time of a first pulse delay time according to the slope of the acceleration or deceleration motion of the carriage; and computing a corrected a duration of a first pulse delay time by substituting constants a and b into the (i+1)-th straight-line equation which is expressible as $$D_{i+1}=D_i'*T_{i+1}+D_i-D_i'*T_i=D_i'*(T_{i+1}-T_i)+D_i=2*D_i-D_{i-1}.$$

8. The method of claim 1, further comprising adding, when a multi-pass printing operation of the ink-jet printer is performed, a specified amount of time to fire pulse delay times corresponding to coordinate values of the coordinate information according to times of each pass of the multi-pass printing operation.

9. The method of claim 8, wherein the specified amount of time provides fire pulses which yield a gap of 2400 dpi for each pass.

10. The method of claim 1, wherein ink is ejected by the generated fire pulse.

11. A computer readable storage medium encoded with processing instructions for causing a computer to perform a method of aligning an image of an ink-jet printer performing a printing operation by ejecting ink according to the movement of a carriage, the method comprising:

detecting a first moving speed of the carriage;

detecting a first fire pulse delay time corresponding to the first detected moving speed from coordinate information in which moving speeds of the carriage and fire pulse delay times corresponding to each of the moving speeds are used as coordinate values; and generating a fire pulse after the first detected fire pulse delay time passes.

12. An apparatus for aligning an image of an ink-jet printer performing a printing operation by ejecting ink according to the movement of a carriage, comprising:

a moving speed detecting unit, which detects a first moving speed of the carriage using a reference clock signal input and an encoder signal and outputs the first detected moving speed;

a coordinate information storage unit, which stores coordinate information in which moving speeds of the carriage and fire pulse delay times corresponding to each of the moving speeds are used as coordinate values;

a delay time providing unit, which provides a first fire pulse delay time corresponding to the first detected moving speed; and a fire pulse generating unit, which generates a fire pulse after the first detected fire pulse delay time passes.

13. The apparatus of claim 12, wherein the delay time providing unit comprises:

a setting coordinate sensing portion, which senses whether a first coordinate in which a first moving speed and a first pulse delay time corresponding to the first moving speed are used as a coordinate value, is set in the coordinate information, and outputs a sensing result; and a delay time drawing-out portion, which draws out the first fire pulse delay time directly from the coordinate information or draws out a first pulse delay time from a straight-line equation passing both a second coordinate in which a second moving speed lower than the first moving speed and a second pulse delay time corresponding to the second moving speed are used as a coordinate value, and a third coordinate in which a third moving speed higher than the first moving speed and a third fire pulse delay time corresponding to the third moving speed are used as a coordinate value in response to the sensing result of the setting coordinate sensing portion.

14. The apparatus of claim 13, further comprising a delay time correcting unit, which corrects the first drawn-out fire pulse delay time according to a slope of an acceleration or deceleration motion of the carriage.

15. The apparatus of claim 12, further comprising a coordinate information modifying unit, which adds a specified amount of time to fire pulse delay times corresponding to coordinates values of the coordinate information according to times of each pass of the multi-pass operation.

16. The apparatus of claim 12, wherein ink is ejected by the generated fire pulse.

17. A method of aligning an image of an ink-jet printer performing a printing operation by ejecting ink according to the movement of a carriage without generating an interrupt in the movement of the carriage, comprising:

detecting a first moving speed of the carriage;

detecting a first fire pulse delay time corresponding to the first detected moving speed from coordinate information in which moving speeds of the carriage and fire pulse delay times corresponding to each of the moving speeds are used as coordinate values; and generating a fire pulse after the first detected fire pulse delay time passes.

18. A delay time providing unit comprising:

a setting coordinate sensing portion which senses whether a first coordinate in which a first moving speed and a first pulse delay time corresponding to the first moving speed are used as a coordinate value, is set in coordinate information, and outputs a sensing result; and a delay time drawing-out portion which draws out, when the sensing result indicates that the first coordinate is set in the coordinate information, a first fire pulse delay time directly from the coordinate information and draws out, when the sensing result indicates that the first coordinate is not set in the coordinate information, a first pulse delay time from a straight-line equation passing both a second coordinate in which a second moving speed lower than the first moving speed and a second pulse delay time corresponding to the second moving speed are used as a coordinate value, and a third coordinate in which a third moving speed higher than the first moving speed and a third fire pulse delay time corresponding to the third moving speed are used as a coordinate value in response to the sensing result of the setting coordinate sensing portion.

19. The delay time providing unit of claim 18, wherein the coordinate information is stored in a storage unit.

20. The delay time providing unit of claim 18, wherein the straight-line equation is $y=-30(x-X)7+Y$, wherein x is a variable indicating the variation in the moving speed of a carriage, y is a variable indicating the variation in a fire pulse delay time obtained according to the variation in x, X is horizontal component of the third coordinate, and Y is the vertical component of the third coordinate.

* * * * *

UNITED STATES PATENT AND TRADEMARK OFFICE

CERTIFICATE OF CORRECTION

PATENT NO. : 7,121,640 B2
APPLICATION NO. : 10/839339
DATED : October 17, 2006
INVENTOR(S) : Kyu-sung Kim It is certified that error appears in the above-identified patent and that said Letters Patent is hereby corrected as shown below:

Column 14, Line 24, change "y=-30(x-X)7+Y," to --y=-30(x-X)/7+Y,--.

Signed and Sealed this

Sixth Day of March, 2007

JON W. DUDAS
*Director of the United States Patent and Trademark Office*